US008244157B2

(12) United States Patent
Shirakata et al.

(10) Patent No.: US 8,244,157 B2
(45) Date of Patent: Aug. 14, 2012

(54) IMAGE-FORMING APPARATUS

(75) Inventors: Jiro Shirakata, Chigasaki (JP); Yoritsugu Maeda, Moriya (JP); Satoshi Atarashi, Toride (JP); Yukihiro Fujiwara, Toride (JP); Dai Kanai, Abiko (JP); Jun Nakagaki, Abiko (JP); Jun Nakazato, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 442 days.

(21) Appl. No.: 12/636,957

(22) Filed: Dec. 14, 2009

(65) Prior Publication Data

US 2010/0158551 A1 Jun. 24, 2010

(30) Foreign Application Priority Data

Dec. 19, 2008 (JP) ..... 2008-324165

(51) Int. Cl.
*G03G 15/00* (2006.01)
*G03G 15/01* (2006.01)

(52) U.S. Cl. ..... 399/167; 399/301

(58) Field of Classification Search ..... 399/167, 399/301, 302; 347/116
See application file for complete search history.

(56) References Cited

U.S. PATENT DOCUMENTS

| | | | | |
|---|---|---|---|---|
| 6,868,244 | B2 * | 3/2005 | Koide | 399/167 |
| 7,630,668 | B2 * | 12/2009 | Abe | 399/167 |
| 2003/0152404 | A1 | 8/2003 | Watanabe et al. | |
| 2003/0223786 | A1 | 12/2003 | Kamoshita et al. | |
| 2005/0129427 | A1 | 6/2005 | Kinoshita et al. | |
| 2006/0220302 | A1 | 10/2006 | Nakano | |

FOREIGN PATENT DOCUMENTS

| | | |
|---|---|---|
| JP | 60-176470 | 9/1985 |
| JP | 10-186952 | 7/1998 |

* cited by examiner

*Primary Examiner* — William J Royer
(74) *Attorney, Agent, or Firm* — Canon USA Inc IP Division

(57) ABSTRACT

An image-forming apparatus includes an image-bearing member configured to bear an image, a transfer belt to which the image on the image-bearing member is transferred and configured to transfer the image onto a sheet, a first drive unit configured to drive the image-bearing member to rotate, a second drive unit configured to drive the transfer belt to rotate via a speed reduction member interposed therebetween, a detection unit configured to detect a circumferential speed of the transfer belt, and a control unit configured to control the first drive unit in accordance with the circumferential speed of the transfer belt detected by the detection unit.

11 Claims, 9 Drawing Sheets

| | NUMBER OF TEETH | AMPLITUDE OF POSITIONAL SHIFT ($\mu$m) | FREQUENCY (Hz) |
|---|---|---|---|
| ERROR FOR ALL TEETH OF DRIVE GEAR 106 | 60 | 50 | 3 |
| ERROR FOR EACH TOOTH OF DRIVE GEAR 106 | 60 | 2 | 180 |
| ERROR FOR ALL TEETH OF SMALL REDUCTION GEAR 107 | 30 | 30 | 6 |
| ERROR FOR ALL TEETH OF LARGE REDUCTION GEAR 107 | 150 | 7.5 | 6 |
| ERROR FOR ALL TEETH OF MOTOR GEAR | 15 | 1.5 | 30 |

FIG. 7A SHIFT IN ROTATIONAL POSITION OF TRANSFER MEMBER
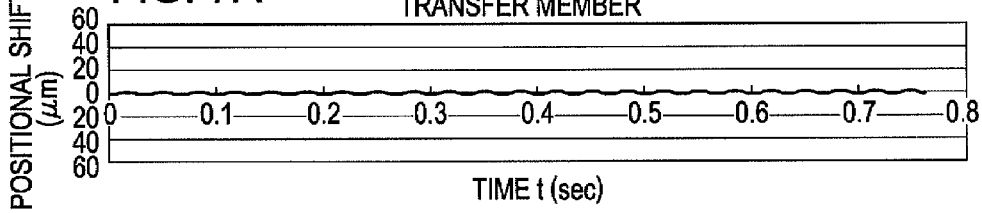
FIG. 7B CHANGE IN ROTATIONAL SPEED OF TRANSFER MEMBER
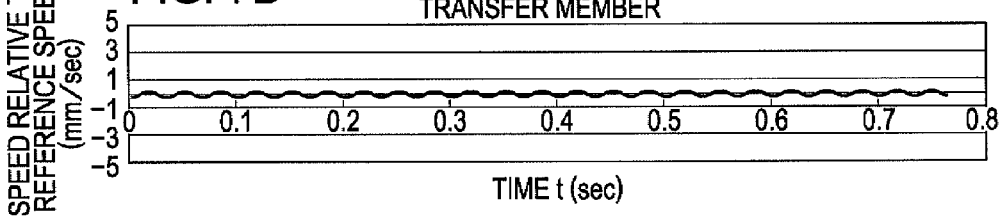
FIG. 7C CHANGE IN ROTATIONAL SPEED OF PHOTOCONDUCTIVE MEMBER
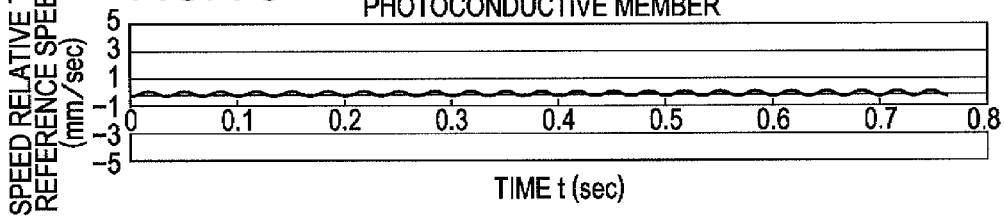
FIG. 7D SHIFT IN ROTATIONAL POSITION OF PHOTOCONDUCTIVE MEMBER
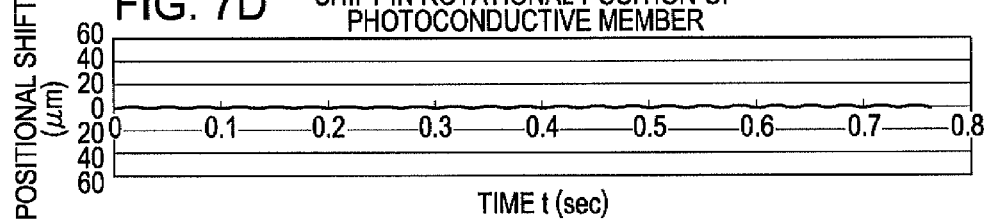
FIG. 7E DIFFERENCE BETWEEN CIRCUMFERENTIAL SPEED OF PHOTOCONDUCTIVE MEMBER AND TRANSFER MEMBER
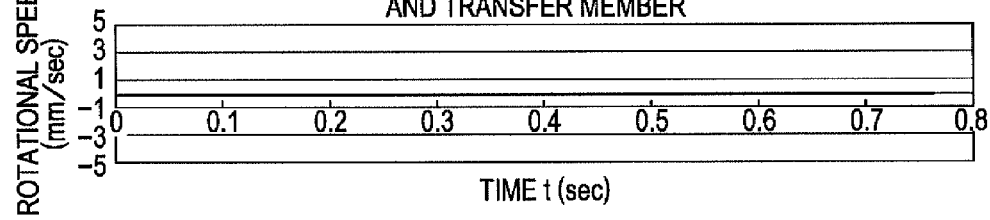

IMAGE-FORMING APPARATUS

BACKGROUND OF THE INVENTION

1. Field of the Invention

The present invention relates to image-forming apparatuses in which image-bearing members and transfer members that are in contact with the image-bearing members are driven to rotate.

2. Description of the Related Art

To form good images with high accuracy in electrophotographic image-forming apparatuses, it is desired that photoconductive members and transfer members in contact with the photoconductive members be driven by drive units with high rotational accuracy. This is because nonuniformity in the driving operation of the drive units may lead to image failure including color misregistration, banding, and blank spots.

Typically, in a color-image-forming apparatus, color misregistration occurs because of shifts in the relative positions of images formed in different colors. One of the causes for such shifts in the relative positions of images is nonuniformity in the operation of driving photoconductive members and transfer members. Banding is variation in density periodically occurring in an image. Banding occurs because of periodical changes in the circumferential speeds of each photoconductive member and the corresponding transfer member during image formation. Blank spots occur because of positional shifts of toner during transfer from each photoconductive member to the corresponding transfer member performed at a transfer nip produced therebetween. The positional shifts of toner at the transfer nip occur because of the relative speed difference between the photoconductive member and the transfer member.

It is known that, in a configuration where the driving force of a motor is transmitted to a photoconductive member or a transfer member through reduction gears, the nonuniformity in the operation of driving the photoconductive member or the transfer member is reduced by detecting the angle of rotation of the photoconductive member or the transfer member, not the angle of rotation of the motor, and feeding the result of detection back to the motor. Thus, the low-frequency component of the nonuniformity in the driving operation is reduced, whereby color misregistration can be suppressed. Such a technique, however, is not effective in reducing the high-frequency component of the nonuniformity in the driving operation caused by the transmission of the driving force through the gears, and it is still difficult to suppress banding and the occurrence of blank spots.

There is a known technique in which a photoconductive member is driven by an oscillatory-wave motor (also known as a vibration-type motor or vibration wave motor) that does not require speed reduction with gears but produces a relatively large torque (as disclosed in Japanese Patent Laid-Open No. 10-186952, for example). Oscillatory-wave motors produce driving forces by exciting oscillatory bodies to generate oscillatory waves and perform relative friction driving of contacting bodies that are in contact with the oscillatory bodies (see Japanese Patent Laid-Open No. 60-176470, for example).

In Japanese Patent Laid-Open No. 10-186952, the photoconductive member is directly driven by an oscillatory-wave motor and the transfer member is driven by a pulse motor with gears interposed therebetween. The circumferential speed of the transfer member is controlled in accordance with the circumferential speed of the photoconductive member. Thus, the photoconductive member and the transfer member can be driven without nonuniformity in the driving operation. In image-forming apparatuses, however, the torque for driving the transfer member is larger than the torque for driving the photoconductive member. To drive such a transfer member by a motor with no gears interposed therebetween, a large motor is required. This is disadvantageous in terms of manufacturing cost and space. Nevertheless, if the photoconductive member is directly driven by an oscillatory-wave motor and the transfer member is driven by a pulse motor or a direct-current (DC) motor with gears interposed therebetween, the high-frequency component of the nonuniformity in the driving operation produced by the transmission of the driving force with the gears cannot be reduced effectively.

SUMMARY OF THE INVENTION

According to an aspect of the present invention, an image-forming apparatus includes an image-bearing member configured to bear an image, a transfer belt to which the image on the image-bearing member is transferred and configured to transfer the image onto a sheet, a first drive unit configured to drive the image-bearing member to rotate, a second drive unit configured to drive the transfer belt to rotate via a speed reduction member interposed therebetween, a detection unit configured to detect a circumferential speed of the transfer belt, and a control unit configured to control the first drive unit in accordance with the circumferential speed of the transfer belt detected by the detection unit.

Further features of the present invention will become apparent from the following description of exemplary embodiments with reference to the attached drawings.

BRIEF DESCRIPTION OF THE DRAWINGS

FIGS. 7A to 7E are graphs for describing the difference between the circumferential speeds of the photoconductive drum and the intermediate transfer belt.

DESCRIPTION OF THE EMBODIMENTS

Figure 1:
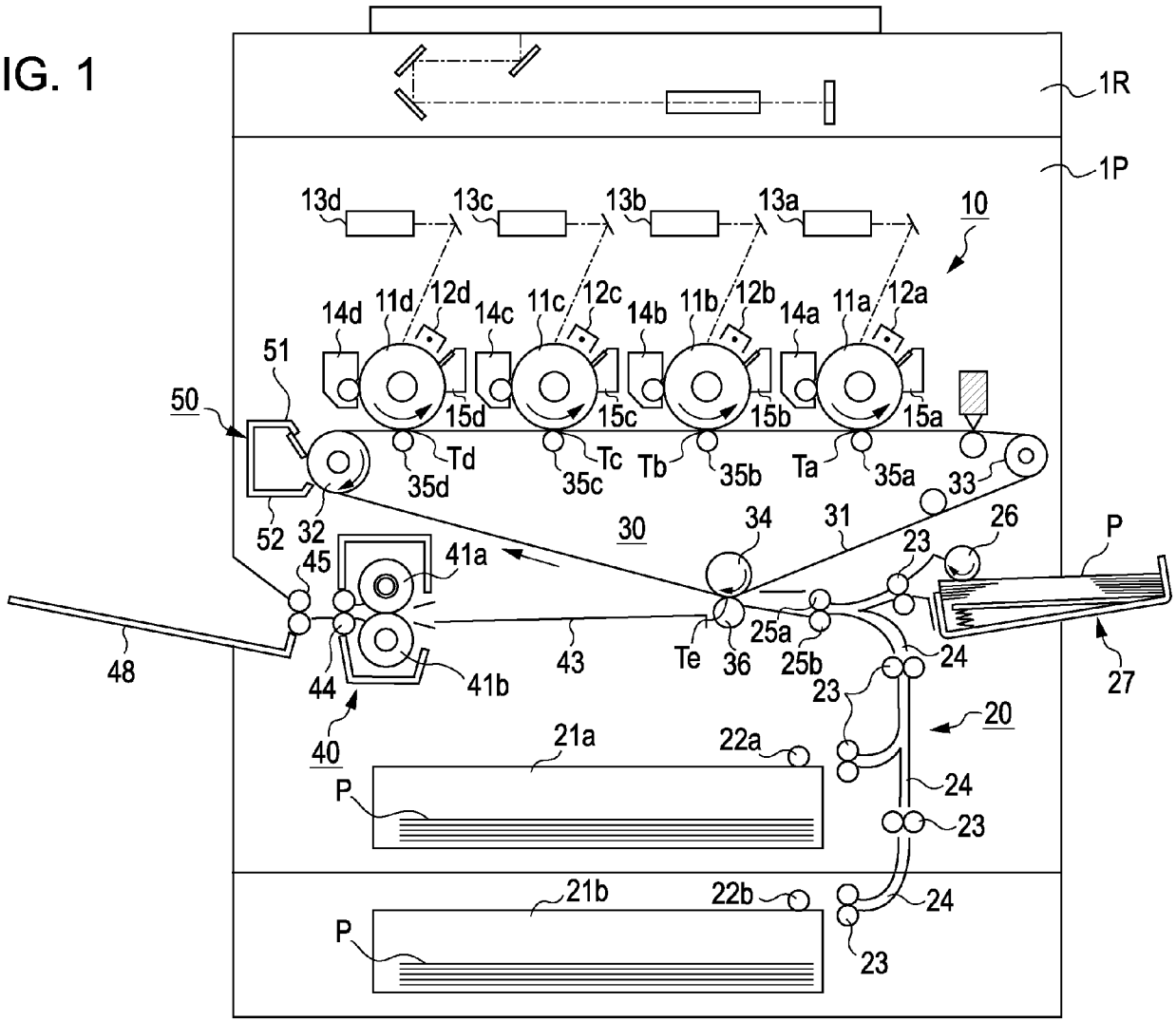
FIG. 1 is a cross-sectional view showing relevant parts of an image-forming apparatus according to an embodiment of the present invention.

FIG. 1 is a cross-sectional view showing relevant parts of an image-forming apparatus according to an embodiment of the present invention. The image-forming apparatus is a color-image-forming apparatus operating as follows: Images in a plurality of colors are formed on a plurality of image-bearing members, the images formed on the image-bearing members are transferred onto a transfer member in such a manner as to be superposed one on top of another, and the resulting image on the transfer member is further transferred onto a sheet. The image-forming apparatus includes a reader 1R configured to read an image of a document and a printer 1P configured to form the image onto a sheet. The printer 1P basically includes an image-forming unit 10 (in which four stations a, b, c, and d having the same configuration are provided in parallel with each other), a sheet-feeding unit 20, an intermediate transfer unit 30, and a fixing unit 40.

The image-forming unit 10 includes the following: photoconductive drums 11*a*, 11*b*, 11*c*, and 11*d*, corresponding to the image-bearing members or photoconductive members, configured to be driven to rotate in the directions of the arrows and journaled at the centers thereof; and primary chargers 12*a*, 12*b*, 12*c*, and 12*d*, optical units 13*a*, 13*b*, 13*c*, and 13*d*, and developers 14*a*, 14*b*, 14*c*, and 14*d* arranged around and facing the outer peripheries of the individual photoconductive drums 11*a* to 11*d*. The primary chargers 12*a* to 12*d* apply charges of a uniform amount to the surfaces of the photoconductive drums 11*a* to 11*d*, respectively. Subsequently, the optical units 13*a* to 13*d* expose the photoconductive drums 11*a* to 11*d*, respectively, with laser beams modulated in accordance with image data, whereby electrostatic latent images are formed on the photoconductive drums 11*a* to 11*d*.

The developers 14*a* to 14*d*, containing toners of four different colors of yellow, cyan, magenta, and black, visualize the electrostatic latent images on the photoconductive drums 11*a* to 11*d* with the toners, respectively. The resulting toner images on the photoconductive drums 11*a* to 11*d* are transferred onto an intermediate transfer belt 31 by primary transfer rollers 35*a*, 35*b*, 35*c*, and 35*d* at primary transfer portions Ta, Tb, Tc, and Td, respectively. Toners not having been transferred onto the intermediate transfer belt 31 and remaining on the photoconductive drums 11*a* to 11*d* are scraped off by cleaners 15*a*, 15*b*, 15*c*, and 15*d*, whereby the surfaces of the photoconductive drums 11*a* to 11*d* are cleaned.

The sheet-feeding unit 20 feeds sheets P stacked in cassettes 21*a* and 21*b* and a manual feed tray 27 one by one. Pickup rollers 22*a*, 22*b*, and 26 deliver the sheets P in the cassettes 21*a* and 21*b* and the manual feed tray 27 one by one, respectively. The sheet P delivered by any of the pickup rollers 22*a*, 22*b*, and 26 is conveyed along a feed guide 24 to registration rollers 25*a* and 25*b* by pairs of feed rollers 23. The registration rollers 25*a* and 25*b* deliver the sheet P to a secondary transfer portion Te in a timing matching the timing of image formation by the image-forming unit 10.

The intermediate transfer unit 30 transfers the toner image on the intermediate transfer belt 31, corresponding to the transfer member, onto the sheet P conveyed thereto by the registration rollers 25*a* and 25*b*. The intermediate transfer belt 31 is stretched between a driving roller 32, a steering roller 33, and an inner secondary-transfer roller 34, and is driven by the driving roller 32 to rotate in the direction of the arrow. The intermediate transfer belt 31 is made of, for example, polyimide or polyvinylidene fluoride. The primary transfer rollers 35*a* to 35*d* are positioned at the respective primary transfer portions Ta to Td, which are provided between the intermediate transfer belt 31 and the photoconductive drums 11*a* to 11*d*, and on the inner surface of the intermediate transfer belt 31. A secondary-transfer roller 36 is provided at the secondary transfer portion Te in such a manner as to face the inner secondary-transfer roller 34. The toner image on the intermediate transfer belt 31 is transferred onto the sheet P by the secondary-transfer roller 36.

A cleaning unit 50 is provided on the intermediate transfer belt 31 on the downstream side with respect to the secondary transfer portion Te. The cleaning unit 50 cleans an image-receiving surface of the intermediate transfer belt 31, and includes a cleaning blade 51 that is in contact with the intermediate transfer belt 31 and a waste toner box 52 that receives waste toner scraped off by the cleaning blade 51. The cleaning blade 51 is made of, for example, polyurethane rubber.

The fixing unit 40 fixes, on the sheet P, the toner image that has been transferred onto the sheet P. The fixing unit 40 performs a fixing process on the sheet P, conveyed thereto along a conveyance guide 43, with a fixing roller 41*a* and a pressing roller 41*b*. The fixing roller 41*a* includes thereinside a heat source such as a halogen heater. The pressing roller 41*b* is pressed against the fixing roller 41*a*. The sheet P discharged from between the fixing roller 41*a* and the pressing roller 41*b* is discharged onto a discharge tray 48 by inner discharge rollers 44 and outer discharge rollers 45.

An image-forming operation performed in the above configuration will now be described. When an image formation start signal is issued, a sheet P is delivered from the cassette 21*a* by the pickup roller 22*a*. The sheet P is guided along the feed guide 24 by the pair of feed rollers 23 and is conveyed to the registration rollers 25*a* and 25*b*. During this conveyance, the registration rollers 25*a* and 25*b* are not in rotation, and the leading end of the sheet P therefore knocks against a nip produced between the registration rollers 25*a* and 25*b*. Subsequently, in a timing in which the image-forming unit 10 starts image formation, the registration rollers 25*a* and 25*b* start rotating. The timing of rotation of the registration rollers 25*a* and 25*b* is set such that the timing in which the sheet P reaches the secondary transfer portion Te matches the timing in which the toner image primary-transferred from the image-forming unit 10 onto the intermediate transfer belt 31 reaches the secondary transfer portion Te.

Meanwhile, in the image-forming unit 10, when the image formation start signal is issued, the toner image formed as above on the photoconductive drum 11*d*, the most upstream one in the direction in which the intermediate transfer belt 31 rotates, is primary-transferred onto the intermediate transfer belt 31 at the primary transfer portion Td by the primary transfer roller 35*d* to which a high voltage is applied. The toner image primary-transferred onto the intermediate transfer belt 31 is then conveyed to the adjacent primary transfer portion Tc. At the primary transfer portion Tc, another toner image is transferred over the toner image that has been transferred at the primary transfer portion Td such that the positions of the two toner images coincide with each other. This process is further repeated. Thus, all the toner images in the four colors are primary-transferred onto the intermediate transfer belt 31.

Subsequently, when the sheet P reaches the secondary transfer portion Te and comes into contact with the intermediate transfer belt 31, a high voltage is applied to the secondary-transfer roller 36 in the timing of the passage of the sheet P, whereby the resulting toner image including the images in the four colors formed as above on the intermediate transfer belt 31 is transferred onto a surface of the sheet P. The sheet P having the resulting toner image is guided along the conveyance guide 43 to a nip produced between the fixing roller 41*a* and the pressing roller 41*b* of the fixing unit 40, and is fixed on the surface of the sheet P with heat and nipping pressure applied by the pair of rollers 41*a* and 41*b* of the fixing unit 40. The sheet P having the fixed toner image is further conveyed by the inner discharge rollers 44 and the outer discharge rollers 45 and is discharged to the outside of the apparatus.

Figure 2:
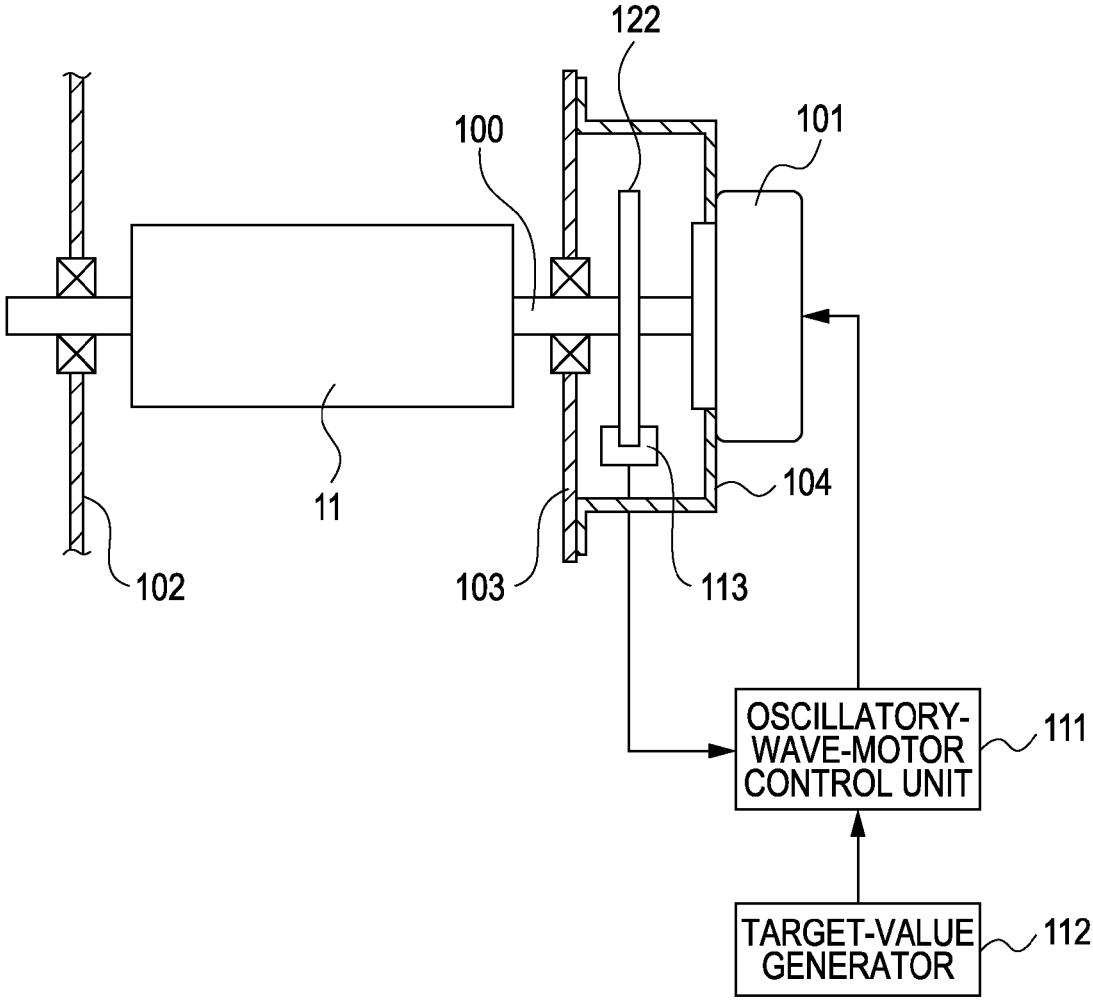
FIG. 2 shows a drive unit that drives a photoconductive drum according to the embodiment.

FIG. 2 shows a drive unit that drives any of the photoconductive drums 11 according to the embodiment. The photoconductive drum 11 is journaled on a drum shaft 100 extending through the center thereof. The photoconductive drum 11 and the drum shaft 100 are joined to each other with high rigidity. The drum shaft 100 is integrally provided with an oscillatory-wave motor 101 (a first drive unit) that performs non-reduction direct driving. The drum shaft 100 functions as the output shaft of the oscillatory-wave motor 101. Oscillatory-wave motors produce driving forces by exciting oscillatory bodies as stators to generate oscillatory waves (traveling waves) and perform relative friction driving of contacting bodies as rotors that are in contact with the oscillatory bodies. The drum shaft 100 is rotatably journaled between a front-side panel 102 and a rear-side panel 103 of the image-forming apparatus. The oscillatory-wave motor 101 is secured to the rear-side panel 103 with a drive-unit scaffold 104 interposed therebetween. The drive-unit scaffold 104 houses an encoder sensor 113 that reads an encoder wheel 122 attached on the drum shaft 100.

An oscillatory-wave-motor control unit 111 (a control unit) performs feedback control of the oscillatory-wave motor 101 such that the output from the encoder sensor 113 becomes a target value generated by a target-value generator 112. The target value output from the target-value generator 112 changes with the change in the circumferential speed of the intermediate transfer belt 31, as described below. The oscillatory-wave-motor control unit 111 controls the circumferential speed of the photoconductive drum 11 to change with the change in the circumferential speed of the intermediate transfer belt 31.

Figure 3:
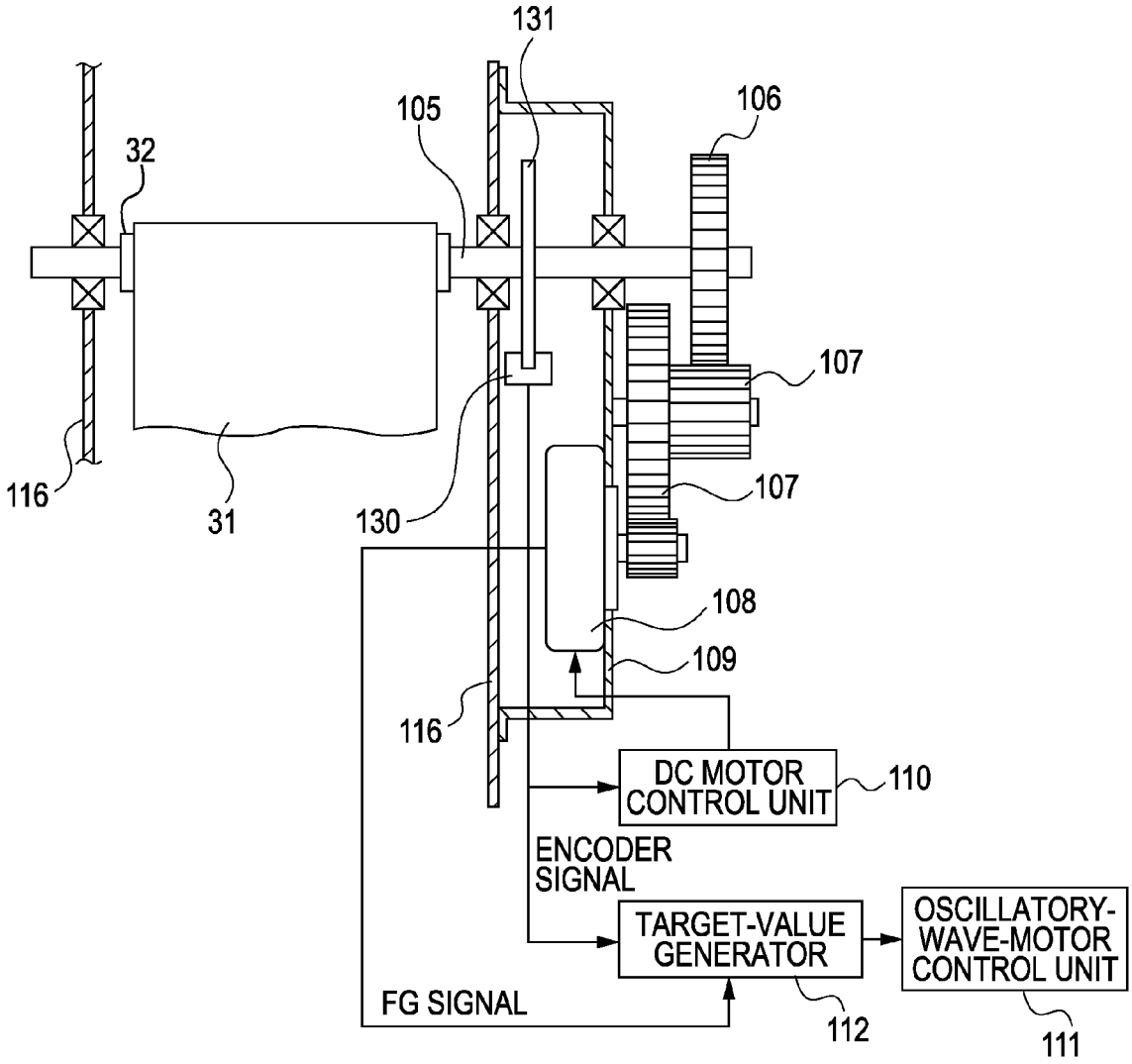
FIG. 3 shows a drive unit that drives an intermediate transfer belt according to the embodiment.

FIG. 3 shows a drive unit that drives the intermediate transfer belt 31 according to the embodiment. A drive shaft 105 extends through the driving roller 32 supporting a part of the intermediate transfer belt 31. The drive shaft 105 is rotatably journaled on an intermediate-transfer-member frame 116. The drive shaft 105 is provided with a drive gear 106 and an encoder wheel 131. The drive gear 106 meshes with a set of reduction gears 107. The set of reduction gears 107 meshes with a DC motor 108 (a second drive unit). The DC motor 108 is secured to a transfer-member drive box 109 on which the drive shaft 105 and the reduction gears 107 are journaled. A train of gears from the DC motor 108 to the drive gear 106 functions as a speed reduction member, whereby a high torque can be applied to the drive shaft 105. The reduction gears 107 transmit the rotation of the DC motor 108 to the drive shaft 105 by reducing the rotation at a ratio of an integer.

A DC motor control unit 110 (a second control unit) detects, with reference to the output from an encoder sensor 130 that detects the value of the encoder wheel 131, the circumferential speed of the intermediate transfer belt 31 and performs feedback control of the DC motor 108 such that the drive shaft 105 rotates at a constant angular speed. The DC motor 108 outputs a frequency-generator (FG) signal per rotation thereof to the target-value generator 112. On the basis of the FG signal, the phase of the rotation angle of the motor is detected. The FG signal is used as information on a home position relative to which the rotation angle of the DC motor 108 is determined.

Figures 4, 5:
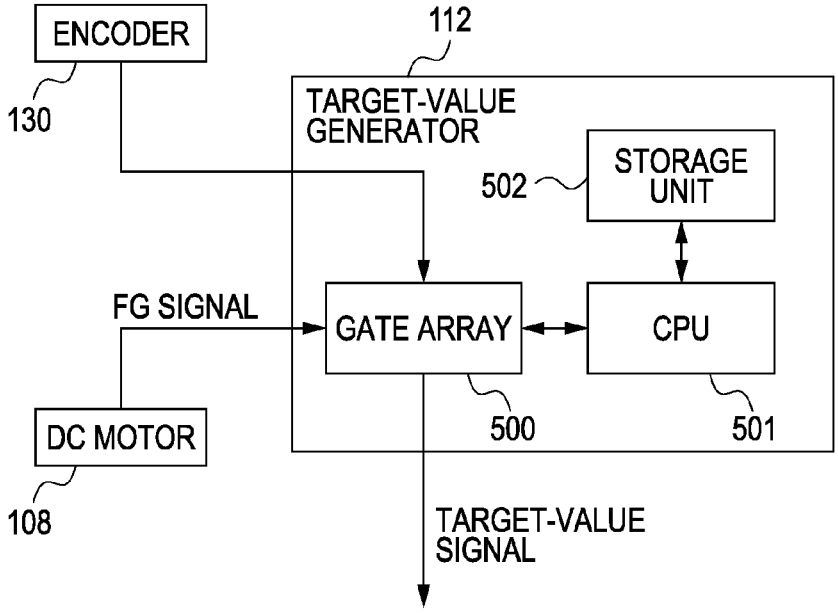
FIG. 4 shows the specifications and the amplitudes and frequencies of positional shifts of gears that transmit the drive force to the intermediate transfer belt.
FIG. 5 is a control block diagram of a target-value generator.

FIG. 4 shows the specifications (the numbers of teeth) and the expected errors of the respective gears that transmit the drive force to the intermediate transfer belt 31. The errors include the amplitudes and frequencies of positional shifts of the gears occurring on the surface of the driving roller 32. The gears each have a factor leading to a positional shift. Therefore, even if the DC motor 108 is feedback-controlled so as to rotate at a constant angular speed, such positional shifts of the gears appear in the form of nonuniformity in the operation of driving the intermediate transfer belt 31, i.e., changes in the circumferential speed of the intermediate transfer belt 31.

The image-forming apparatus of the embodiment includes the target-value generator 112 that successively generates target values (target speeds) of the oscillatory-wave motor 101. The target-value generator 112 generates, with reference to the FG signal output from the DC motor 108, a target angular speed corresponding to the phase and frequency of the drive shaft 105 in which nonuniformity in the driving operation by the aforementioned gears occurs.

FIG. 5 is a control block diagram of the target-value generator 112. FIGS. 6A to 6D are graphs for describing the generation of a target angular speed by the target-value generator 112. An encoder signal is input to the target-value generator 112 and is converted into data representing changes in speed, shown in FIG. 6A, by a gate array 500. Meanwhile, the FG signal that has been input to the target-value generator 112 generates a home-position signal, shown in FIG. 6B, per rotation of the DC motor 108. With reference to the home-position signal, the gate array 500 generates a sine wave, shown in FIG. 6C, having a phase θ and an amplitude A. The gate array 500 calculates the difference, shown in FIG. 6D, between the data on changes in speed shown in FIG. 6A and the sine wave shown in FIG. 6C. Information on the difference for a specific period of time is stored in a storage unit 502.

Figure 6A:
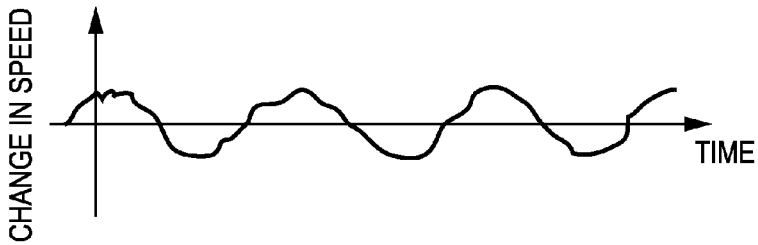
FIGS. 6A to 6D are graphs for describing the generation of a target sine wave by the target-value generator.
Figure 6B:
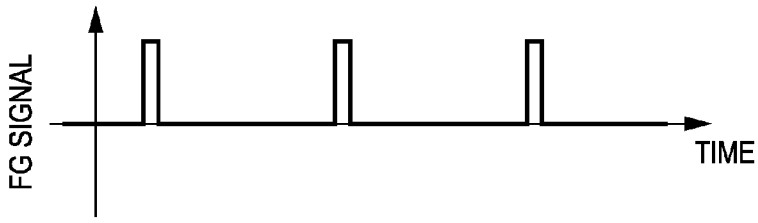
Figure 6C:
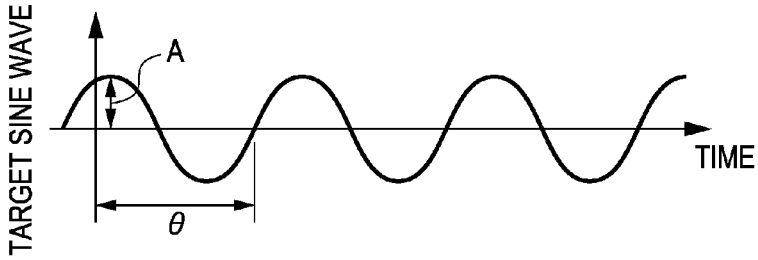
Figure 6D:
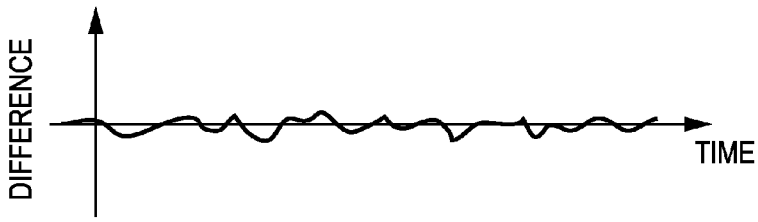

A central processing unit (CPU) 501 changes the phase θ and the amplitude A, thereby identifying such a phase θ and an amplitude A that the integral value of the difference shown in FIG. 6D becomes the smallest. Thus, the target-value generator 112 generates the sine wave as the target angular speed. Thus, the target-value generator 112 extracts changes in the rotational speed of the drive shaft 105 (changes in a single rotational period of the DC motor 108) caused by the effect of the reduction gears 107 in the operation of driving the intermediate transfer belt 31.

The target angular speed calculated by the target-value generator 112 are input to the oscillatory-wave-motor control unit 111, shown in FIG. 2, provided for driving of the photoconductive drum 11. The oscillatory-wave-motor control unit 111 performs feedback control of the oscillatory-wave motor 101 such that the output from the encoder sensor 113 follows the target angular speed. The oscillatory-wave motor 101, which performs non-reduction direct driving, provides a drive system that produces a small inertia and has a high rigidity. Accordingly, the servo bandwidth of such a drive system is high, enabling satisfactory following of the target sine-wave value. Thus, the oscillatory-wave-motor control unit 111 controls the circumferential speed of the photoconductive drum 11 to change with the change in the circumferential speed of the intermediate transfer belt 31.

FIGS. 7A to 7E are graphs for describing the difference between the circumferential speeds of the photoconductive member (the photoconductive drum 11) and the transfer member (the intermediate transfer belt 31). FIG. 7A shows the shift in the circumferential position of the transfer member during constant-angular-speed feedback control from the circumferential position of the transfer member when the circumferential speed could be controlled at a constant speed. FIG. 7B shows the change in the circumferential speed of the transfer member during constant-angular-speed feedback control. The target-value generator 112 generates a target value corresponding to the change in the circumferential speed of the transfer member. The oscillatory-wave-motor control unit 111 changes the circumferential speed of the photoconductive member in accordance with the change in the circumferential speed of the transfer member. FIG. 7C shows the change in the circumferential speed of the photoconductive member controlled in accordance with the change in the circumferential speed of the transfer member. FIG. 7D shows the shift in the circumferential position of the photoconductive member controlled in accordance with the change in the circumferential speed of the transfer member. As a result of changing the circumferential speed of the photoconductive member, which is operated by direct drive, in accordance with the change in the circumferential speed of the transfer member, which is operated by reduction drive, the relative difference between the circumferential speeds of the photoconductive member and the transfer member is reduced, as shown in FIG. 7E. Accordingly, the relative difference between the circumferential speeds of the intermediate transfer belt 31 and the photoconductive drum 11 at the transfer nip therebetween is markedly reduced. This prevents the positional shift of toner at the transfer nip. Consequently, image failure such as the occurrence of blank spots can be suppressed.

When the photoconductive drum 11 is driven in accordance with the target sine-wave value, the position of the latent image drawn on the photoconductive drum 11 by the optical unit 13 shifts in accordance with the positional shift of the photoconductive drum 11 shown in FIG. 7D. The positional shift is expressed as a waveform at relatively high frequencies, resulting in a small cumulative positional shift. Therefore, the problem of color misregistration is negligible. However, the circumferential speed changes with an amplitude that is not negligible, resulting in a possibility of banding. To avoid this, the embodiment provides a mechanism that corrects the position of the electrostatic latent image to be formed on the photoconductive drum 11.

Figure 8:
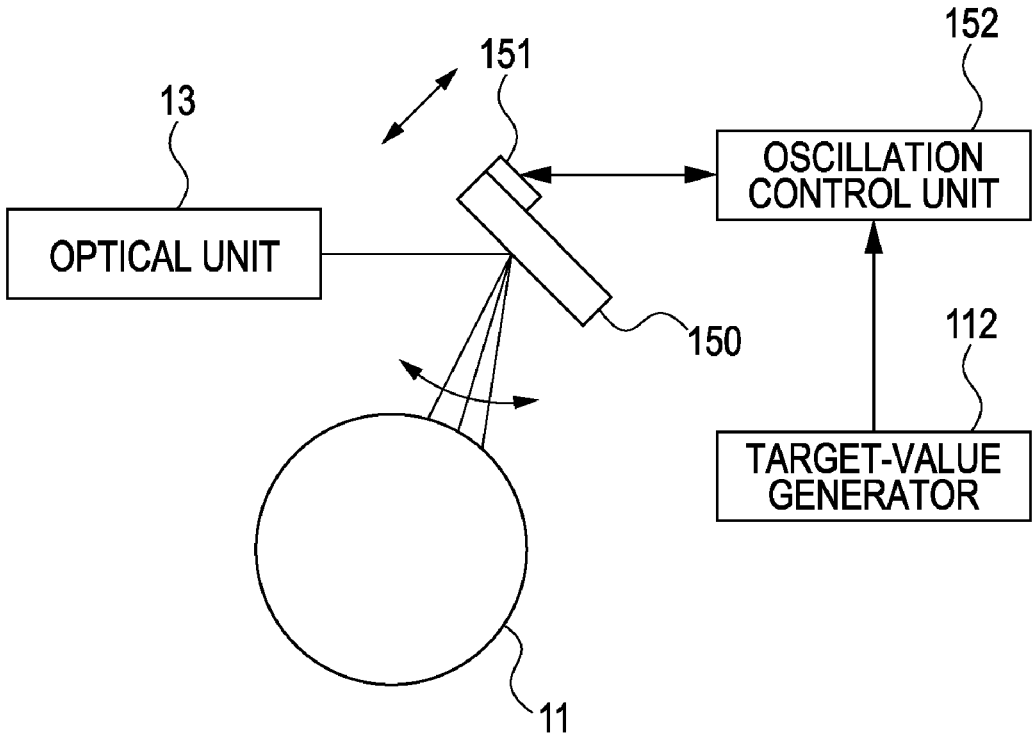
FIG. 8 shows a mechanism that corrects the position at which a laser beam from an optical unit is to be applied to the photoconductive drum.

FIG. 8 shows the mechanism that corrects the position on the photoconductive drum 11 where a laser beam from the optical unit 13 is to be applied. The optical unit 13 emits a laser beam modulated in accordance with a recorded-image signal. The laser beam is reflected by a redirecting mirror 150 toward the photoconductive drum 11. The redirecting mirror 150 is provided with a piezoelectric device 151 capable of applying a specific oscillation to the redirecting mirror 150 (capable of displacing the redirecting mirror 150 so as to have a specific angle). An oscillation control unit 152 controls the oscillation (displacement angle) of the redirecting mirror 150 by controlling the voltage applied to the piezoelectric device 151.

The target sine-wave value generated by the target-value generator 112 is input to the oscillation control unit 152. The oscillation control unit 152 generates such an applied-voltage signal that the positional shift of the latent image is corrected in accordance with the target sine-wave value. The oscillation control unit 152 supplies the applied voltage to the piezoelectric device 151. Thus, the piezoelectric device 151 is driven to oscillate in accordance with the target sine-wave value. Therefore, even if the photoconductive drum 11 is driven in accordance with the target sine-wave value and produces the waveform as shown in FIG. 7D, electrostatic latent images are formed on the photoconductive drum 11 without being shifted and at constant intervals.

Figure 9A:
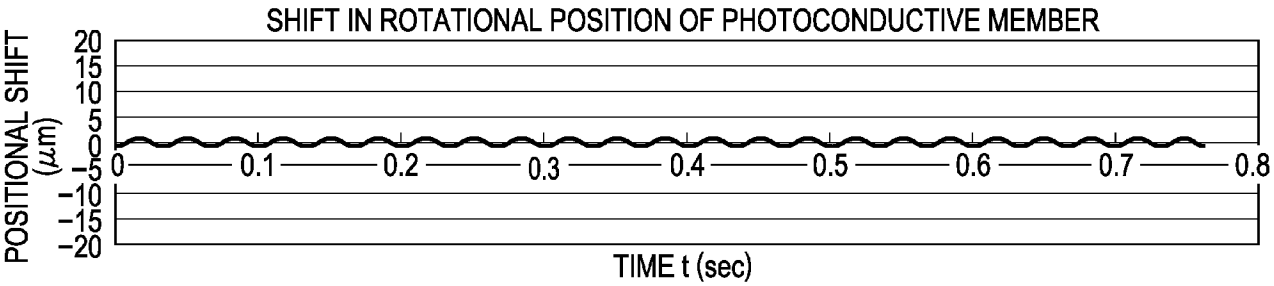
FIGS. 9A to 9C are graphs for describing the correction of the positional shift of an electrostatic latent image on the photoconductive drum.
Figure 9B:
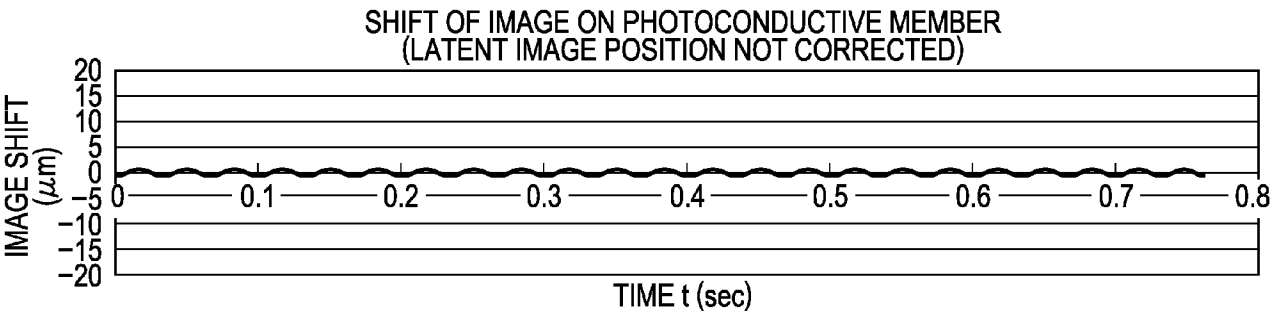
Figure 9C:
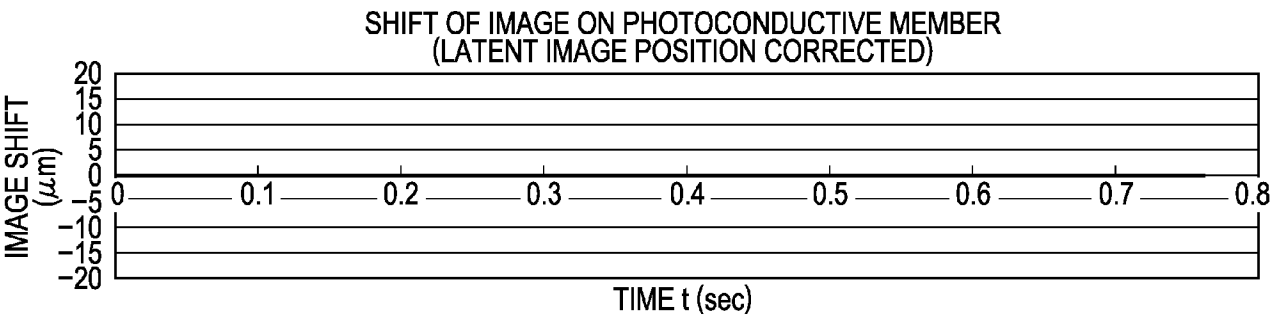

FIGS. 9A to 9C are graphs for describing the correction of the positional shift of the electrostatic latent image on the photoconductive drum 11. FIG. 9A shows the positional shift of the photoconductive drum 11. FIG. 9B shows a comparative example, specifically, the positional shift of the latent image on the photoconductive drum 11 occurring when the position of the latent image is not corrected. FIG. 9C shows the positional shift of the latent image on the photoconductive drum 11 occurring when the position of the latent image on the photoconductive drum 11 is corrected. Such correction reduces the positional shift of the latent image occurring when a laser beam is applied to the photoconductive drum 11 whose circumferential speed is changed with the change in the circumferential speed of the intermediate transfer belt 31. Thus, the occurrence of image failure such as banding can be suppressed.

Figure 10:
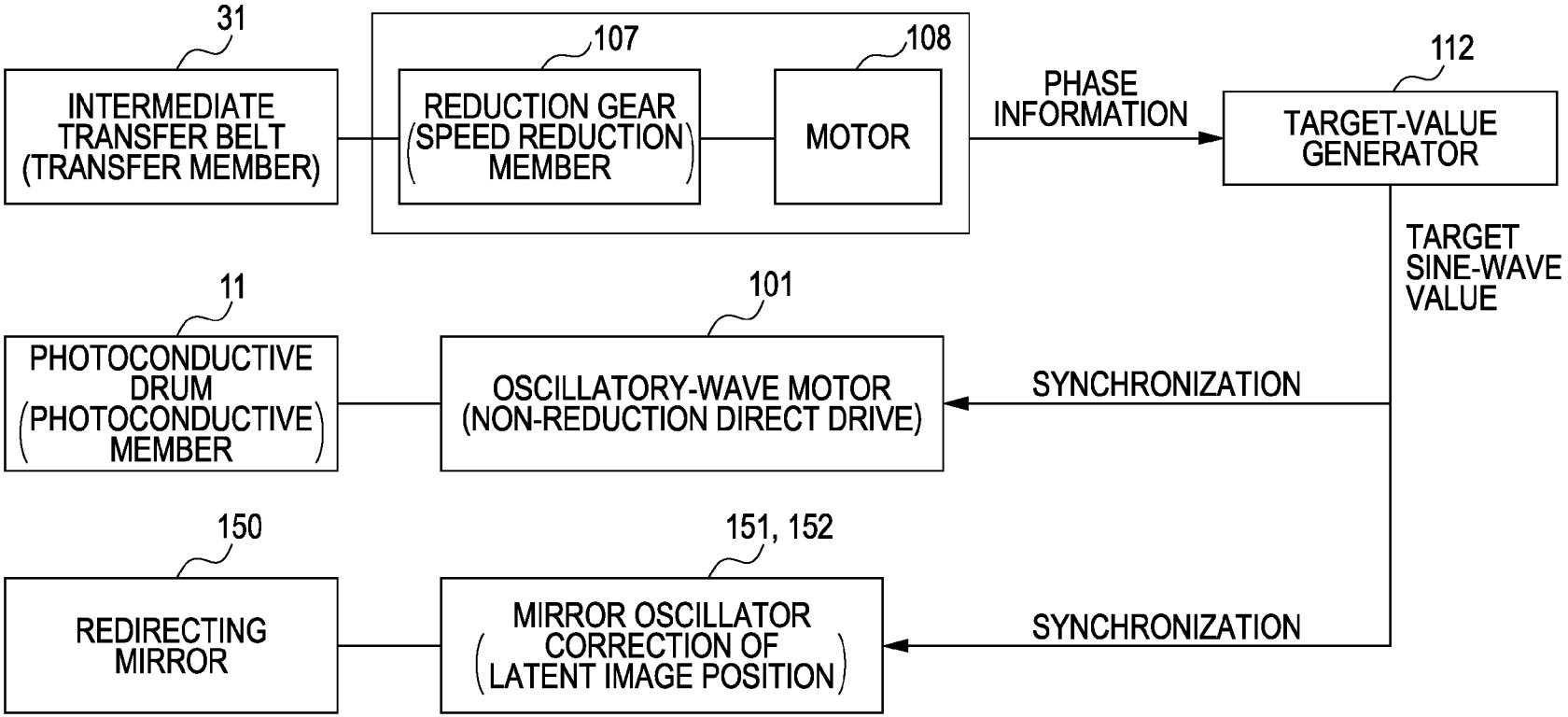
FIG. 10 schematically shows a configuration in which the intermediate transfer belt, the photoconductive drum, and a redirecting mirror are controlled.

FIG. 10 schematically shows a configuration in which the intermediate transfer belt 31, the photoconductive drum 11, and the redirecting mirror 150 are controlled. The intermediate transfer belt 31, which is operated by reduction drive and is therefore most difficult to correct, causes positional shifts at high frequencies. The photoconductive drum 11 and the redirecting mirror 150, which are operated by non-reduction direct drive and therefore have good followability, are synchronized with the intermediate transfer belt 31. Thus, color misregistration, banding, and the occurrence of blank spots can be simultaneously optimized with a simple configuration.

While the embodiment employs the intermediate transfer belt 31, the present invention may alternatively be applied to an image-forming apparatus employing, instead of the intermediate transfer belt 31, an intermediate transfer drum, a direct transfer belt, or a direct transfer drum. Furthermore, while the embodiment employs the oscillatory-wave motor 101 as a drive unit for the photoconductive drum 11, the oscillatory-wave motor 101 may be substituted by a non-reduction direct-drive unit such as a DC direct motor.

Moreover, the phase of the DC motor 108, which is detected on the basis of the FG signal from the DC motor 108 in the embodiment, may alternatively be detected by an optical sensor or the like provided on a member whose speed is reduced at a ratio of an integer with respect to the speed of the motor included in the train of gears functioning as a speed reduction member. In addition, the position of the latent image, which is corrected by the piezoelectric device 151 provided on the redirecting mirror 150 in the embodiment, may alternatively be corrected by utilizing a surface emitting laser or by controlling the timing of emission from a solid-state light-emitting device such as a light-emitting diode (LED).

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-324165 filed Dec. 19, 2008, which is hereby incorporated by reference herein in its entirety.

What is claimed is:

1. An image-forming apparatus comprising:

an image-bearing member configured to bear an image;

a transfer belt to which the image on the image-bearing member is transferred and configured to transfer the image onto a sheet;

a first drive unit configured to drive the image-bearing member to rotate;

a second drive unit configured to drive the transfer belt to rotate via a speed reduction member interposed therebetween;

a detection unit configured to detect a circumferential speed of the transfer belt; and a control unit configured to control the first drive unit in accordance with the circumferential speed of the transfer belt detected by the detection unit.

2. The image-forming apparatus according to claim 1, further comprising:

an image-forming unit configured to form an image on the image-bearing member; and a correction unit configured to correct, in accordance with the circumferential speed of the transfer belt detected by the detection unit, a position of the image to be formed on the image-bearing member by the image-forming unit.

3. The image-forming apparatus according to claim 2, further comprising an exposure unit configured to radiate a laser beam to the image-bearing member via a mirror in accordance with image data, wherein the correction unit displaces an angle of the mirror in accordance with the circumferential speed of the transfer belt detected by the detection unit.

4. The image-forming apparatus according to claim 1, wherein the speed reduction member is a reduction gear.

5. The image-forming apparatus according to claim 1, wherein the speed reduction member performs speed reduction at a ratio of an integer.

6. The image-forming apparatus according to claim 1, wherein the first drive unit is an oscillatory-wave motor that excites an oscillatory body to generate an oscillatory wave and performs friction driving of a contacting body that is in contact with the oscillatory body, and wherein the first drive unit drives the image-bearing member without a speed reduction member.

7. The image-forming apparatus according to claim 1, wherein the control unit controls the first drive unit such that a circumferential speed of the image-bearing member matches the circumferential speed of the transfer belt.

8. The image-forming apparatus according to claim 1, further comprising:

a second detection unit configured to detect a circumferential speed of the image-bearing member, wherein the control unit controls the first drive unit in accordance with the circumferential speeds of the transfer belt and the image-bearing member detected by the detection unit and the second detection unit.

9. The image-forming apparatus according to claim 8, further comprising a second control unit configured to control the second drive unit in accordance with the circumferential speed of the transfer belt detected by the detection unit.

10. The image-forming apparatus according to claim 1, wherein the control unit controls the first drive unit such that the circumferential speed of the image-bearing member follows a target sine-wave value corresponding to the circumferential speeds of the transfer belt detected by the detection unit.

11. The image-forming apparatus according to claim 10, wherein the control unit controls a phase and an amplitude of the target sine-wave value such that the difference between the circumferential speeds of the transfer belt and the image-bearing member is reduced.

* * * * *